US010148022B2

(12) United States Patent
Huang et al.

(10) Patent No.: US 10,148,022 B2
(45) Date of Patent: Dec. 4, 2018

(54) CABLE CONNECTOR ASSEMBLY

(71) Applicant: FOXCONN INTERCONNECT TECHNOLOGY LIMITED, Grand Cayman (KY)

(72) Inventors: Shuai-Hui Huang, Kunshan (CN); Ru-Yang Guo, Kunshan (CN); Qing-Man Zhu, Kunshan (CN); Jerry Wu, New Taipei, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/851,594

(22) Filed: Dec. 21, 2017

(65) Prior Publication Data

US 2018/0175523 A1 Jun. 21, 2018

(30) Foreign Application Priority Data

Dec. 21, 2016 (CN) ..... 2016 2 1406298 U

(51) Int. Cl.
*H01R 13/66* (2006.01)
*H01R 12/53* (2011.01)
*H01R 12/71* (2011.01)

(52) U.S. Cl.
CPC ..... *H01R 12/53* (2013.01); *H01R 12/716* (2013.01); *H01R 13/6691* (2013.01)

(58) Field of Classification Search
CPC ... H01R 13/6691; H01R 12/53; H01R 12/716
USPC ..... 439/620.15, 490
See application file for complete search history.

(56) References Cited

U.S. PATENT DOCUMENTS 5,034,846 A * 7/1991 Hodge ..... H01R 13/6666 361/119
6,752,649 B2 * 6/2004 Arkin ..... H01R 31/065 439/491
7,429,188 B2 * 9/2008 Wu ..... H01R 13/7172 439/490
7,540,773 B2 * 6/2009 Ko ..... H01R 13/5808 439/581
7,628,619 B2 * 12/2009 Chuang ..... H01R 13/6658 439/620.08
7,722,363 B2 * 5/2010 Zhou ..... H01R 12/515 439/490
7,744,231 B2 * 6/2010 Hutchinson ..... G02B 6/0001 362/555

(Continued)

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

A cable connector assembly includes: a plug connector including plural conductive terminals; a cable including plural core wires, a braided layer coated the core wires, a cap coated the braided layer, and a metal member; a printed circuit board (PCB) including a first surface and a second surface opposite to the first surface, the plug connector being mounted on the first surface of the PCB; wherein the first surface of the PCB has three grounding holes at one end of the PCB, the second surface has plural conductive pads, the metal member includes a ring clamping the braided layer and a grounding portion extending from the ring, the grounding portion includes three grounding fingers inserted into the three grounding holes, respectively.

20 Claims, 8 Drawing Sheets

(56) References Cited

U.S. PATENT DOCUMENTS

| | | | | |
|---|---|---|---|---|
| 7,753,689 | B1 * | 7/2010 | Wu | H01R 13/648 439/490 |
| 7,914,320 | B2 * | 3/2011 | Ko | H01R 13/7175 439/490 |
| 8,011,935 | B2 * | 9/2011 | Ko | H01R 13/5845 439/490 |
| 8,535,088 | B2 * | 9/2013 | Gao | H01R 9/03 439/490 |
| 8,641,445 | B2 * | 2/2014 | Su | H01R 13/7175 439/490 |
| 9,017,092 | B1 * | 4/2015 | McCracken | H01R 13/62 439/374 |
| 9,065,205 | B2 * | 6/2015 | Gao | H01R 13/5808 |
| 9,480,169 | B2 * | 10/2016 | Huang | H01R 13/504 |
| 9,705,263 | B2 * | 7/2017 | Huang | H01R 13/7175 |
| 9,780,503 | B2 * | 10/2017 | Huang | H01R 13/5213 |
| 2006/0246783 | A1 * | 11/2006 | Ho | H01R 13/508 439/669 |
| 2015/0214677 | A1 * | 7/2015 | Huang | H01R 13/7175 439/39 |
| 2016/0240984 | A1 * | 8/2016 | Huang | H01R 13/7175 |

* cited by examiner

CABLE CONNECTOR ASSEMBLY

BACKGROUND OF THE INVENTION

1. Field of the Invention

The present disclosure relates to a cable connector assembly.

2. Description of Related Arts

U.S. Pat. No. 9,705,263 discloses a plug connector assembly including a printed circuit board (PCB) and a cable welded on the PCB. The covering layer of the cable is connected with a metal member. The metal member includes only two soldering tails welded on the PCB.

An improved cable connector assembly is desired.

SUMMARY OF THE INVENTION

Accordingly, an object of the present invention is to provide a cable connector assembly capable of strengthening the holding capacity of the cable.

To achieve the above object, a cable connector assembly comprises: a plug connector including plural conductive terminals; a cable including plural core wires, a braided layer coated the core wires, a cap coated the braided layer, and a metal member; a printed circuit board (PCB) including a first surface and a second surface opposite to the first surface, the plug connector being mounted on the first surface of the PCB; wherein the first surface of the PCB has three grounding holes at one end of the PCB, the second surface has plural conductive pads, the metal member includes a ring clamping the braided layer and a grounding portion extending from the ring, the grounding portion includes three grounding fingers inserted into the three grounding holes, respectively.

Other objects, advantages and novel features of the invention will become more apparent from the following detailed description when taken in conjunction with the accompanying drawings.

DETAILED DESCRIPTION OF THE PREFERRED EMBODIMENT

Figure 1:
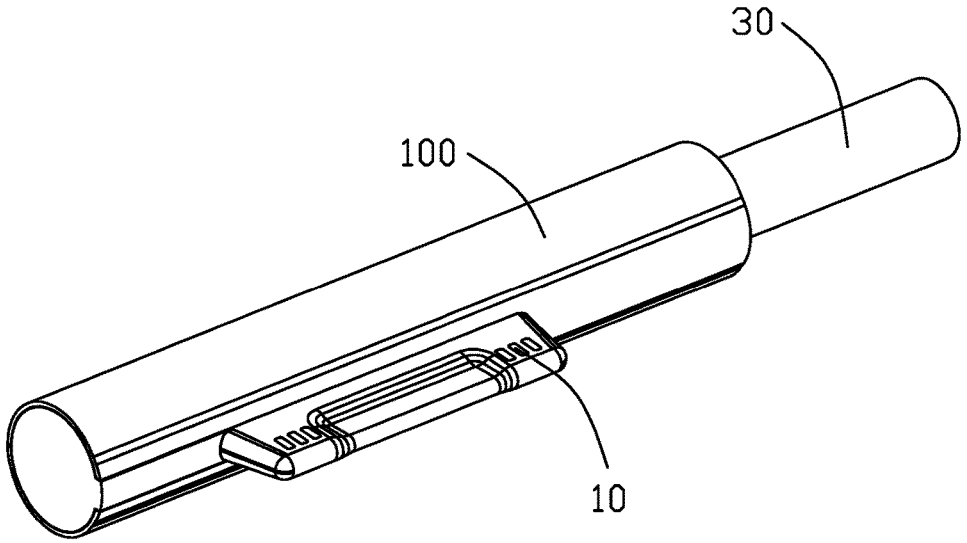
FIG. 1 is a perspective view of a cable connector assembly.
Figure 2:
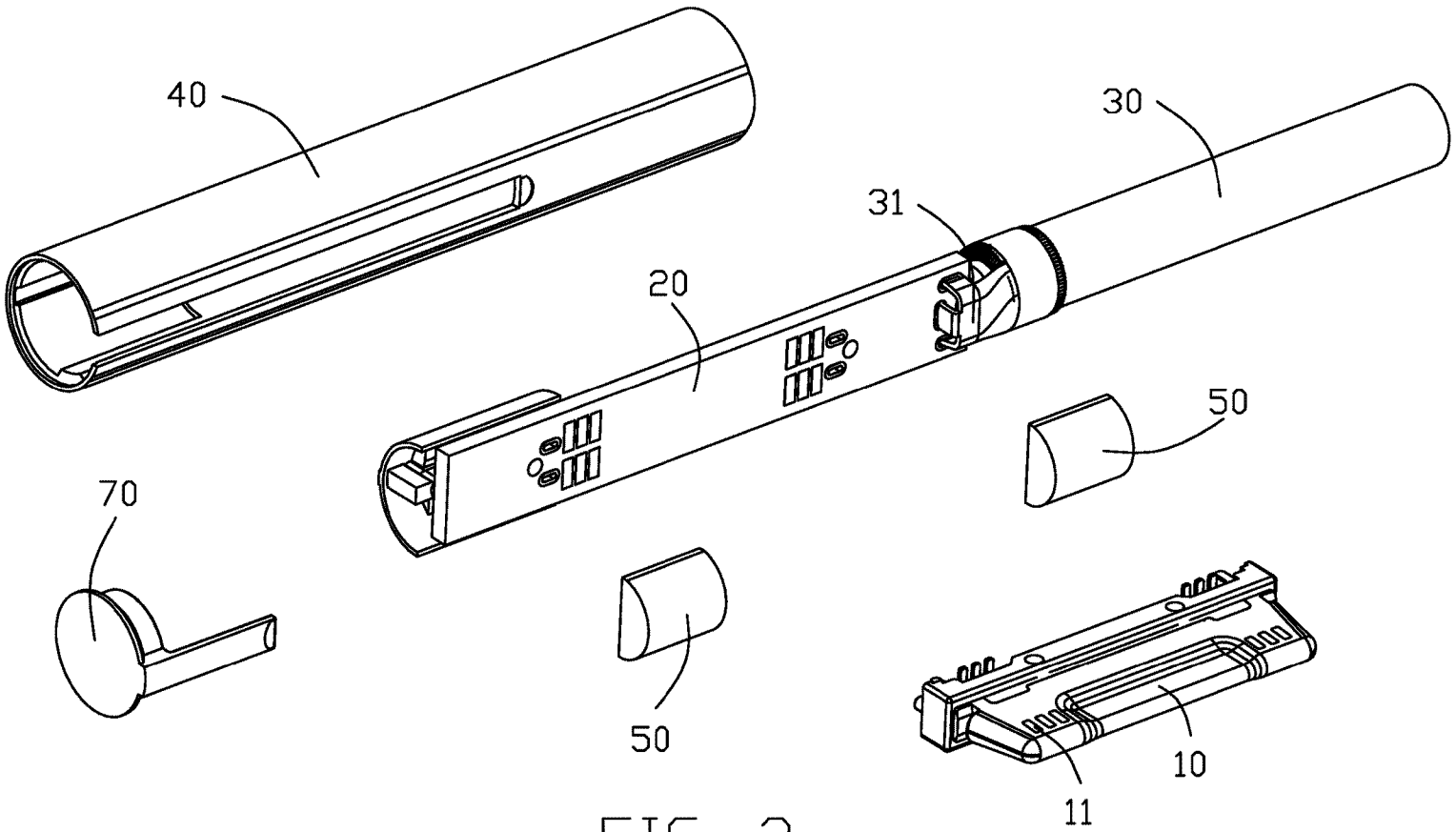
FIG. 2 is an partial exploded view of cable connector assembly as show in FIG. 2.
Figure 3:
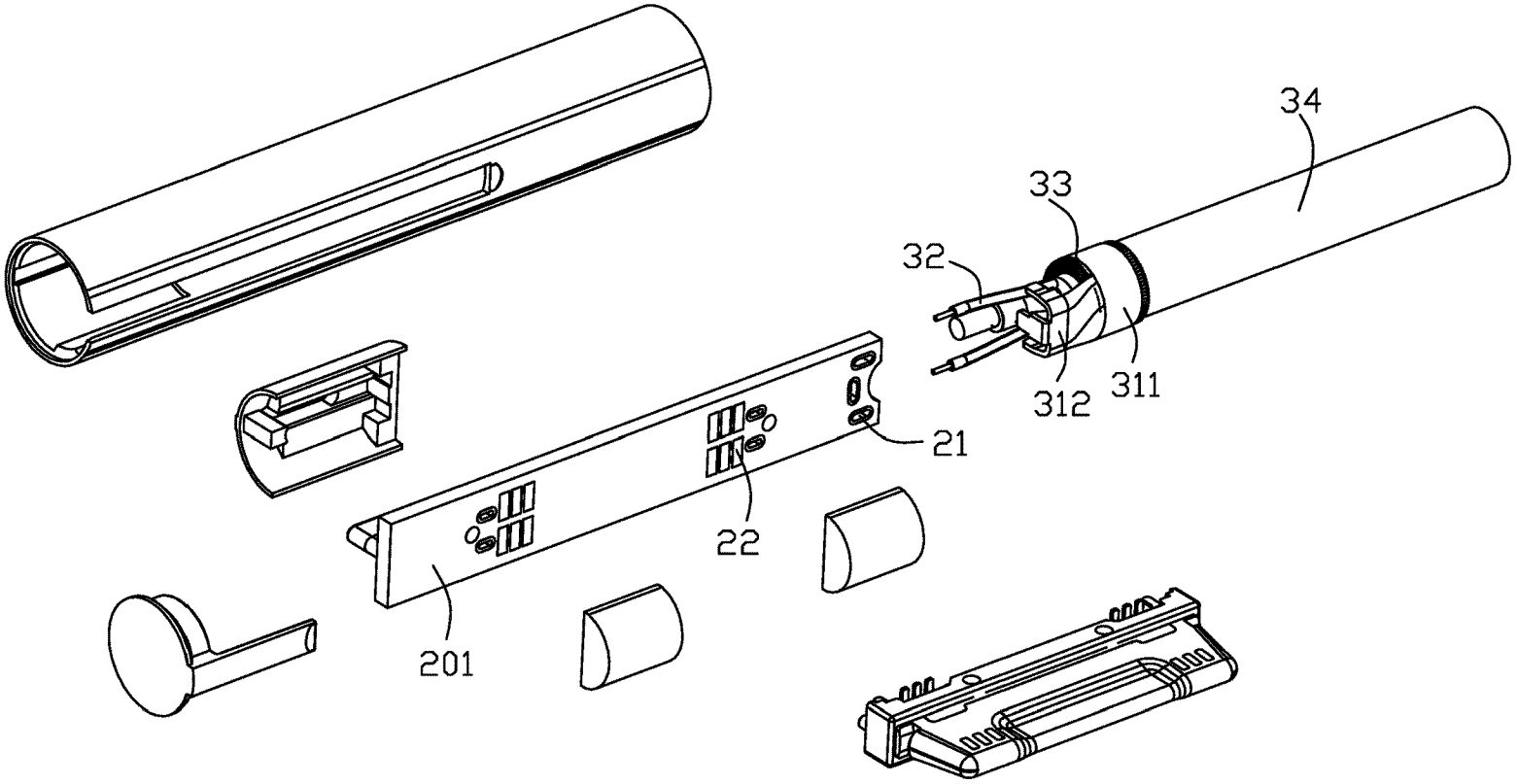
FIG. 3 is a further exploded view of cable connector assembly as shown in FIG. 2.
Figure 4:
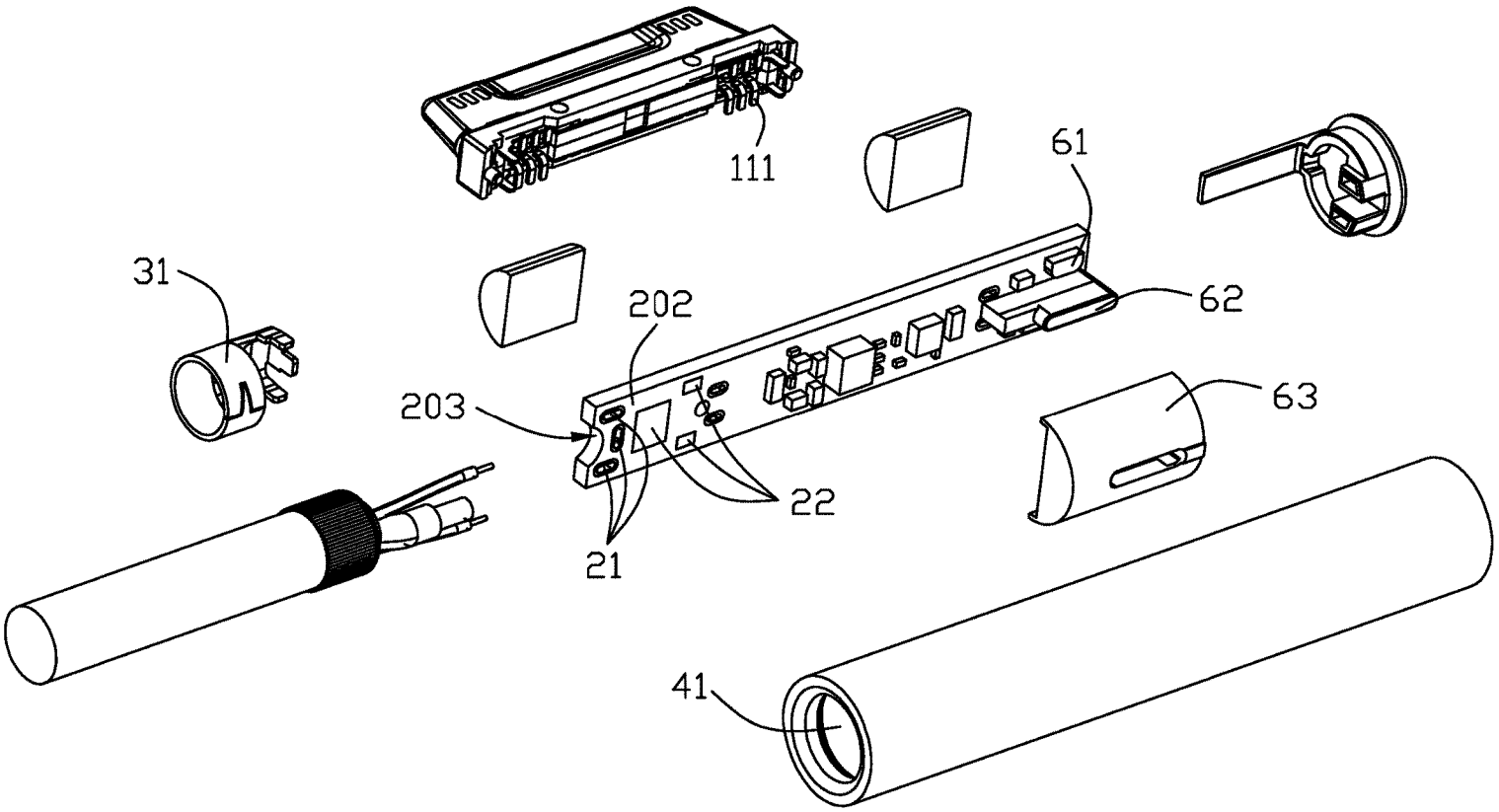
FIG. 4 is another further exploded view of plug connector as shown in FIG. 2.
Figure 5:
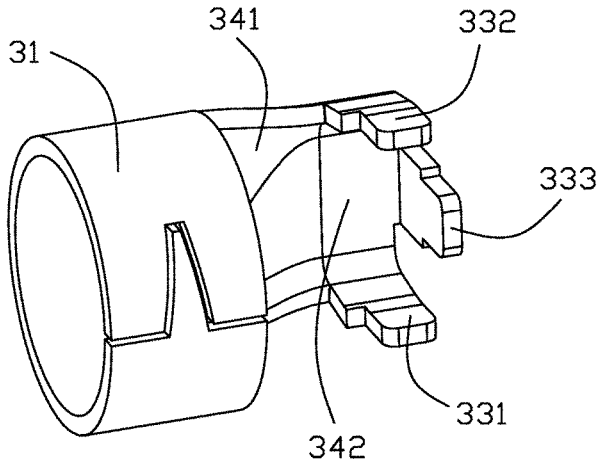
FIG. 5 a perspective view of a metal member.
Figure 6:
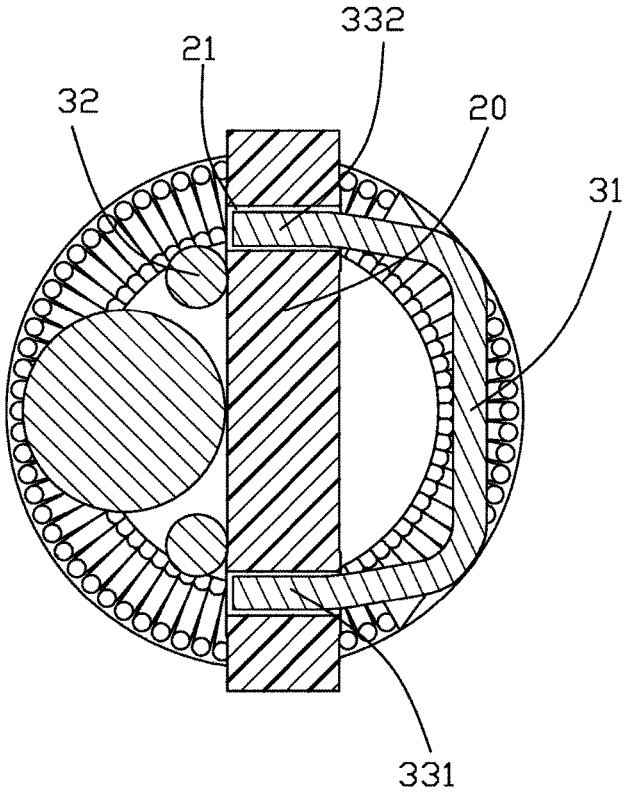
FIG. 6 is a cross-sectional view of the cable connector assembly of FIG. 1.
Figure 7:
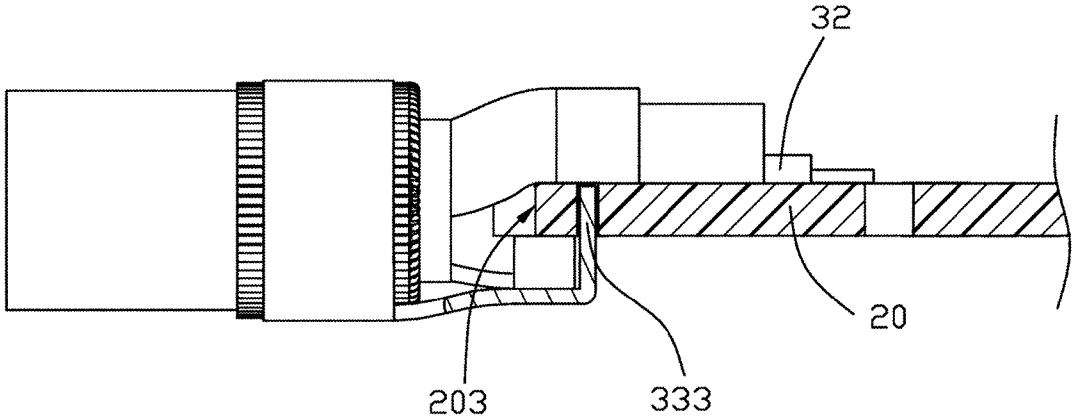
FIG. 7 is a side view of the cable connector assembly of FIG. 1 without the shell and a part is partially cross-sectioned to show the large core wire extends through the notch.

Reference will now be made in detail to the preferred embodiment of the present invention.

Referring to FIGS. 1 to 8, a cable connector assembly 100 includes a plug connector 10, a printed circuit board 20, and a cable 30. The plug connector 10 is fixed with conductive terminals 11. The printed circuit board 20 includes a first surface 201 and a second surface 202 opposite to the first surface 201. The plug connector 10 is mounted on the first surface 201. The first surface 201 includes three grounding holes in the end side, the three grounding holes are arranged in a "door" type, and the second surface 202 includes conductive pads 22. The cable 30 extending along an axial direction, includes core wires 32 including a center large one and two side small ones respectively welded on the conductive pads 22, a braided layer 33 coated the core wires 32, an insulative cap or insulator 34 coated the braided layer 33 and a crimping metal member 31. The metal member 31 includes a ring 311 clamped the braided layer 33 and a grounding portion 312 extending from the ring 311. The grounding portion 312 includes three grounding fingers 331,332,333 inserted into the three grounding holes 21 respectively. The grounding portion 312 also includes an elastic arm 341 extending from the ring 31 to the printed circuit board 20, a connecting portion 342 extending from the front edge of elastic arm 341 in the transverse. Two ends of the connecting portion 342 vertically bent out of the first grounding finger 331 and second grounding finger 332. The front edge of the connecting portion 342 vertically bent out of the third grounding fingers 333. Third the grounding finger 333 is perpendicular to the first and second grounding finger 331, 332. The present invention relates to grounding portion 312 including three grounding fingers 331,332,333, which makes the holding force between the print circuit boards more stable, and at the same time, it can also ensure the requirement of temperature rise when the cable connector assembly transmits high current.

A description of other components of the cable connector assembly 100 is as follows.

The cable connector assembly 100 also includes an insulative shell 40. One end of the printed circuit board 20 and cable 30 is received in the insulative shell 40. The plug 10 passes through the insulative shell 40 and is exposed to the outside. The printed circuit board 20 has pads 22. The conductive terminals are welded on the pads 22 of the printed circuit board 20 by SMT process. One end of the insulative shell 40 has a through hole 41 for the cable 30 through. The size of the through hole 41 is less than printed circuit board 20, but with the same size of cable 30.

The plug 20 is in the shape of the tongue plate and vertically mounts on the printed circuit board 20. The conductive terminals 11 are exposed to the opposite sides of the tongue plate and located at both ends of each side of the tongue plate while depressed in the middle of the tongue plate.

The first surface 201 of the printed circuit board 20 has two magnetic components 4 located at both ends of the plug 10.

The second surface 201 of the printed circuit board 20 has a pair of LEDs 61, a light guide member 62 transmitting the light of LEDs 61 and a shading/retaining member 63 covering the LEDs 61 and light guide member 62. The light guide member 62 and shading/retaining member 63 locate in the insulative shell 40. The insulative shell 40 has a front plug at the other end of the cable 30.

Figure 8:
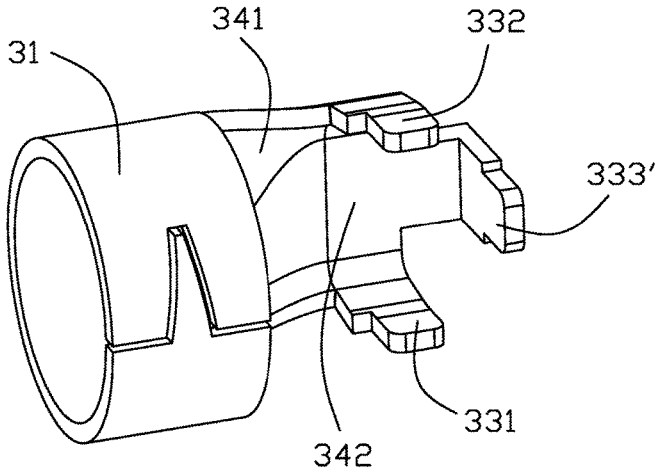
FIG. 8 is a perspective view of a metal member according to another embodiment.

The feature of the invention is to provide the grounding portion of the metal member with three grounding fingers extending through the corresponding three holes in the PCB with a triangular configuration thereof, i.e., being nonlinear, wherein the corresponding grounding holes 21 are located behind the corresponding conductive pads 22 on which the corresponding core wires 32 are soldered. In this embodiment, the rear edge of the printed circuit board forms a notch 203 so as to allow a portion of the center large core wire 32 to pass. FIG. 8 shows another embodiment in which the middle grounding fingers 333' further extends forward from the ring for better stability thereof.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A cable connector assembly comprising:

a plug connector including plural conductive terminals;

a cable including plural core wires, a braided layer coated the core wires, a cap coated the braided layer, and a metal member;

a printed circuit board (PCB) including a first surface and a second surface opposite to the first surface, the plug connector being mounted on the first surface of the PCB; wherein the first surface of the PCB has three grounding holes at one end of the PCB, the second surface has plural conductive pads, the metal member includes a ring clamping the braided layer and a grounding portion extending from the ring, the grounding portion includes three grounding fingers inserted into the three grounding holes, respectively.

2. The cable connector assembly as claimed in claim 1, wherein the grounding portion includes an elastic arm extending from the ring to the PCB and a connecting portion extending from the front edge of elastic arm, two ends of the connecting portion vertically bent out of a first grounding finger and a second grounding finger, a front edge of the connecting portion vertically bent out of a third grounding finger and perpendicular to the first and second grounding fingers.

3. The cable connector assembly as claimed in claim 1, further including an insulative shell, wherein one end of the PCB and the cable is received in the insulative shell, and the plug connector passes through the insulative shell and is exposed to outside.

4. The cable connector assembly as claimed in claim 1, wherein one end of the insulative shell has a through hole for the cable to extend through, and a size of the through hole is less than the PCB and is same as the cable.

5. The cable connector assembly as claimed in claim 3, wherein the plug is in the shape of a tongue plate and vertically mounted on the PCB, the conductive terminals are exposed to two opposite sides of the tongue plate and located at both ends of each side of the tongue plate and depressed at a middle of the tongue plate.

6. The cable connector assembly as claimed in claim 5, wherein the PCB has plural pads, and the conductive terminals are surface mounted to the pads.

7. The cable connector assembly as claimed in claim 6, further comprising two magnetic components located on the first surface of the PCB at two ends of the plug.

8. The cable connector assembly as claimed in claim 5, further comprising a pair of LEDs on the second surface of the PCB, a light guide member for transmitting the light of LEDs, and a shading member covering the LEDs and the light guide member, wherein the light guide member and shading member are located in the insulative shell.

9. A cable connector assembly comprising:

an elongated printed circuit board extending along an axial direction and defining thereon opposite first and second surfaces in a direction perpendicular to the axial direction;

a plug connector mounted upon the printed circuit board in said direction;

a cable connected to a rear end region of the printed circuit board and including a plurality of core wires and a braided layer surrounding the core wires; and a metal member including a ring crimping the braided layer and a grounding portion unitarily extending forwardly from the ring; wherein front end regions of the core wires are positioned upon the second surface and soldered to corresponding conductive pads on the second surface, the grounding portion is located upon the first surface and forms a plurality of grounding fingers extending, in said direction, into the grounding holes formed in the printed circuit board, while the ring is located behind a rear edge of the printed circuit board.

10. The cable connector assembly as claimed in claim 9, wherein said conductive pads, on which the core wires are soldered, are located in front of the grounding holes in the axial direction.

11. The cable connector assembly as claimed in claim 10, wherein an amount of the grounding fingers is at least three extending into three corresponding grounding holes, respectively, in said direction.

12. The cable connector assembly as claimed in claim 11, wherein viewed in said direction, said three grounding holes are arranged with a triangular configuration.

13. The cable connector assembly as claimed in claim 12, wherein said three grounding holes includes a middle one and two side ones, said middle one being located in front of the two side ones.

14. The cable connector assembly as claimed in claim 13, wherein on the second surface, three are three conductive pads on which three core wires are soldered, and viewed along said direction, said three conductive pads is configured with another triangle which is opposite to said triangle in the axial direction.

15. The cable connector assembled in claim 14, wherein the three core wires include a large one and two small one, and a rear edge of the printed circuit board defines a notch to allow the large one core wire to pass.

16. The cable connector assembly as claimed in claim 9, wherein a mating direction of said plug connector is same with said direction.

17. A cable connector assembly comprising:

an elongated printed circuit board extending along an axial direction and defining thereon opposite first and second surfaces in a direction perpendicular to the axial direction;

a plug connector mounted upon the printed circuit board in said direction;

a cable connected to a rear end region of the printed circuit board and including a plurality of core wires and a braided layer surrounding the core wires; and a metal member including a ring crimping the braided layer and a grounding portion unitarily extending forwardly from the ring; wherein the grounding portion is located upon the first surface and forms at least three grounding fingers extending, in said direction, into the grounding holes formed in the printed circuit board, and the ring is located behind a rear edge of the printed circuit board; wherein said three grounding fingers are arranged with a triangle viewed in said direction.

18. The cable connector assembly as claimed in claim 17, wherein said three grounding holes includes a middle one and two side ones, said middle one being located in front of the two side ones.

19. The cable connector assembly as claimed in claim 18, wherein on the second surface, three are three conductive pads on which three core wires are soldered, and viewed along said direction, said three conductive pads is configured with another triangle which is opposite to said triangle in the axial direction.

20. The cable connector assembled in claim 19, wherein the three core wires include a large one and two small one, and a rear edge of the printed circuit board defines a notch to allow the large one core wire to pass.

* * * * *